United States Patent [19]

Kothe et al.

[11] Patent Number: 4,602,577

[45] Date of Patent: Jul. 29, 1986

[54] DRIVE AND CONTROL DEVICE FOR SEWING MACHINES, AUTOMATIC SEWING INSTALLATIONS, AND THE LIKE

[75] Inventors: Peter Kothe, Darmstadt-Eberstadt; Wolfgang Angersbach, Darmstadt; Dan-Corneliu Raducanu, Bad Soden; Peter Schüler, Obertshausen; Michaeal Luft, Seeheim-Jugenheim, all of Fed. Rep. of Germany

[73] Assignee: Quick-Rotan Electromotoren GmbH, Fed. Rep. of Germany

[21] Appl. No.: 517,406

[22] Filed: Jul. 26, 1983

[30] Foreign Application Priority Data

Aug. 2, 1982 [DE] Fed. Rep. of Germany ..... 3228789

[51] Int. Cl.[4] ..... D05B 19/00; D05B 27/22

[52] U.S. Cl. ..... 112/121.11; 112/275; 112/272; 112/315

[58] Field of Search ..... 112/275, 277, 121.11, 112/262.1, 314, 315, 2, 272

[56] References Cited

U.S. PATENT DOCUMENTS

| | | | |
|---|---|---|---|
| 4,381,719 | 5/1983 | Goldbeck | 112/275 X |
| 4,403,558 | 9/1983 | Martell et al. | 112/275 X |
| 4,404,919 | 9/1983 | Martell et al. | 112/121.11 |
| 4,495,877 | 1/1985 | Willenbacher | 112/275 X |

*Primary Examiner*—Peter Nerbun

*Attorney, Agent, or Firm*—Antonelli, Terry & Wands

[57] ABSTRACT

A drive and control device for sewing machines, automatic sewing installations, and the like, with a recognition unit which responds for the purpose of end recognition when the sewing tools have approached a predetermined spacing from the desired seam end. The drive and control device also includes a preselection stitch counting unit, which can be triggered by means of the recognition unit, for the presetting of a predetermined number of remaining stitches still to be executed subsequently to the end recognition, and a correction unit for the performance of a stitch correction in dependence on the respective needle position at the instant of end recognition. The correction unit serves for automatically varying the length of at least one of the remaining stitches.

31 Claims, 19 Drawing Figures

FIG. 11
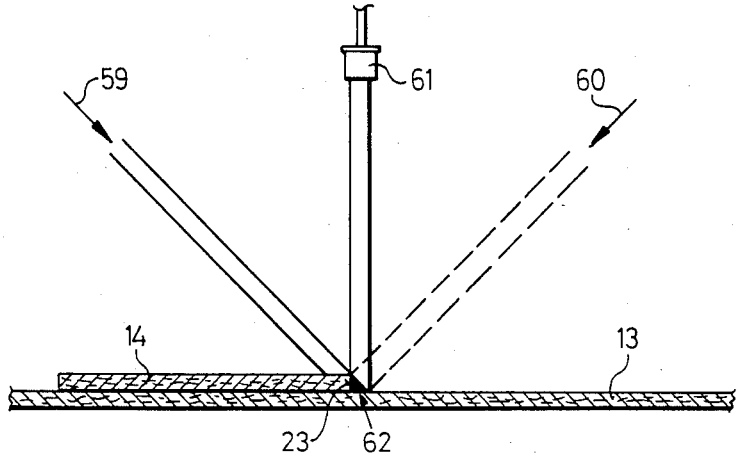
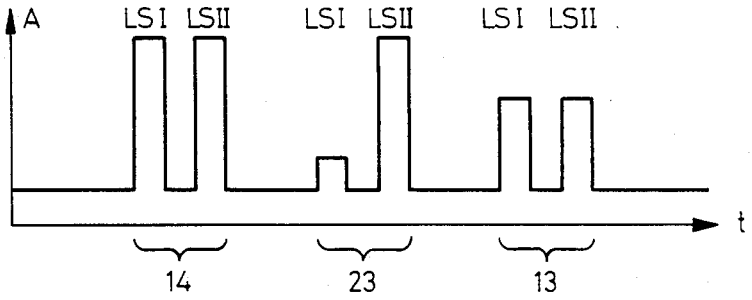
FIG. 12

13
65
14
A2
A1
A3
A0
Y
X
0

ENVELOPE CURVE OF $v_x$
$v_{MATERIAL}$
n
t
A2
A3
ε

FEEDING NOT PERMITTED
(k-1) REV.
k.REV.
(k+1) REV.
$v_{MATERIAL}$
n LINEARLY INCREASING
t
u ≙ NEEDLE AT BOTTOM
o ≙ NEEDLE AT TOP

FIG. 18
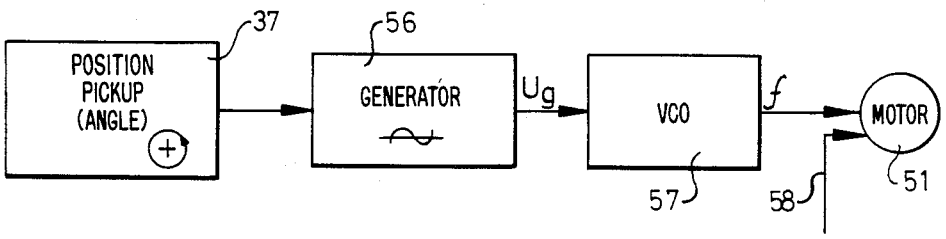
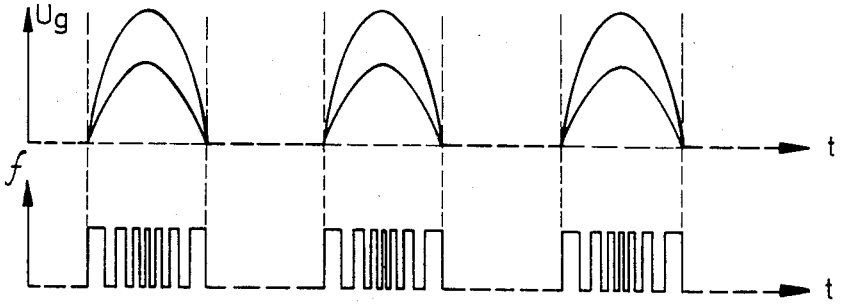
FIG. 19

DRIVE AND CONTROL DEVICE FOR SEWING MACHINES, AUTOMATIC SEWING INSTALLATIONS, AND THE LIKE

The present invention relates to a drive and control device for sewing machines, automatic sewing installations, and the like.

A conventional drive and control device for sewing machines is disclosed in German Offenlegungsschrift No. (DOS) 3,018,797, wherein the drive mechanism is provided with a recognition unit which responds, for the purpose of end recognition, when the sewing tools have approached a predetermined spacing from the desired seam end, with a preselection stitch counting unit, which can be triggered by the recognition unit, for the presetting of a predetermined number of remaining stitches to be executed subsequently to the end recognition, and with a correction unit for the performance of the stitch correction in dependence on the respective needle position at the instant of end recognition. That is, in accordance with the DOS, the number of remaining stitches executed following the end recognition can be varied by one by the correction unit. This has the result that the maximum deviation of the last needle puncture lies at a maximum either one-half stitch length in front of or one-half stitch length behind the desired end of the seam in dependence upon whether one stitch is added or subtracted from the predetermined number of remaining stitches after end recognition. Such an accuracy, however, is still substantially lower than the accuracy obtained by an experienced seamstress without automatic seam length determination. The seam maladjustment resulting from this known arrangement, consequently, is still much too extensive, especially in the case of high-quality sewing material.

It is, therefore, an object of the present invention to provide a drive and control device for automatic sewing machines which overcomes the disadvantages of the prior art arrangements.

It is another object of the present invention to provide a drive and control device which improves the appearance of a seam produced by an automatic sewing machine.

These objects, are attained in accordance with the present invention, by providing a correction unit which enables the length of at least one of remaining stitches after end recognition to be adjustable. Thus, while in the prior art arrangement, the executed stitches are always of a uniform length, and correction is effected merely by varying the number of remaining stitches, if necessary, by one, the present invention provides for the execution of remaining switches with an automatically adapted stitch length, if needed. Thereby, the deviation of the last needle puncture from the desired point of penetration at the desired seam end, can be made considerably smaller than half a stitch length.

Under practical conditions, the actual feeding phase, i.e., the phase within which the sewing material can be moved with respect to the needle during each rotation of the sewing machine main or arm shaft, varies in dependence on the model of the machine as well as the extent of wear of the machine. In accordance with the present invention, these factors can be taken into consideration by utilization of an input or memory unit having a hardware construction or in the form of a programmed computer arrangement for taking into consideration a machine-specific translatory factor between the needle position and the feeding phase of the machine.

According to another feature of the present invention, the transposition factor, i.e., a correction factor between the angle assumed by the main shaft of the sewing machine at the instant of end recognition with respect to a predetermined reference angle position, for example, the angular position "needle at bottom" and the associated feeding phase, can be a constant factor or can be dependent on the feeding phase of the sewing material. It is desirable that this factor be dependent on the feeding phase so that the present invention provides for a drive and control device wherein the function of the correction unit is made dependent on the feeding phase prevailing at the instant of end recognition. Further, the instructions required for stitch length adjustment are advantageously made available by a unit of the drive and control device which stores the needle position prevailing at the instant of end recognition, expressed in increments with respect to a reference position. Such unit, may also store information of the feeding phase present at the instant of end recognition.

According to a further feature of the present invention, the correction unit includes a setting mechanism which varies the length of at least one remaining stitch continuously or stepwise by an amount directly dependent on the needle position prevailing at the instant of end recognition. Such an arrangement enables, for example, the dimensioning of the last stitch or the penultimate stitch in such a manner that the last needle puncture is congruent with the desired end of the seam. As such, a seam appearance is attained which is practically no longer distinguishable from that of a hand-sewn seam. The only flaw herein may be that the length of the correction stitch, deviating in the seam pattern from the length of the other stitches, is discernable. In order to counteract this disadvantage, the setting mechanism of the correction unit advantageously provides for adjusting the length of the number of the remaining stitches in dependence on the needle position prevailing at the instant of end recognition by a predetermined fraction of the respectively provided, full stitch length. Thus, any relatively large stitch length corrections which may be necessary are distributed over several remaining stitches. In this manner, the correction becomes practically invisible and the seam pattern is equal to or better than that of a hand-sewn seam.

While the drive and control device of the present invention can be constructed so that the stitch length is only shortened or only lengthened, the correction becomes less perceptible if the stitch length, in dependence on the needle position at the instant of end recognition, is lengthened or shortened as required, i.e., if correction towards both sides is possible. In according with the present invention, a correction unit is provided which enables the length of one or more of the remaining stitches to be lengthened or shortened in accordance with a relation, on the one hand, between the needle position and the feeding phase at the instant of end recognition, and, on the other hand, the set, full stitch length and the predetermined fraction of the full stitch length.

According to another feature of the present invention, the correction unit may be coupled with and act on the stitch regulator customarily present in sewing machines. However, the correction unit may also be coupled with a feeding unit for the sewing material which, during the execution of the remaining stitches and with an unchanged stitch length setting, can be brought out of engagement with the sewing material for the purpose of adjustment of stitch length, in dependence on the correction unit.

According to a further feature of the present invention, rather than controlling the engagement of the sewing material by the feeding unit, the correction unit may be directly coupled with a separate feed drive mechanism so as to effect stitch length correction by controlling the feed drive mechanism to feed the sewing material. In this arrangement, the feeding velocity and/or the duration of feeding of the sewing material can be adusted for the remaining stitch or stitches to be corrected.

In the case of sewing machine installation having a coordinate table exhibiting an X-drive and a Y-drive, the present invention provides that the correction unit enables control of the X-drive and the Y-drive separately or jointly, as required.

Further, the drive and control device of the present invention is suitable not only for sewing machines when the sewing material is moved, in all cases, while the needle out of engagement with the sewing material, but the present invention is also suitable for sewing machines with a needle feed. In such an arrangement, the correction unit includes a synchronizing device for detecting the horizontal component of the needle movement and for regulating the feed drive mechanism in dependence thereon.

The present invention also provides that the recognition unit may be of several different types. For example, the recognition unit may include a transmission or a reflection light barrier. Alternatively, the recognition unit may comprise a UV light transmitter-receiver unit for the recognition of a border of a sewing material, impregnated or coated with ink which lights up under UV light. Additionally, the recognition unit may comprise a shadow detector in the form of two alternatingly actuatable light sources and a light receiver to detect light level difference between the light signals of the two light sources. The recognition unit may also include a series of detector cells aligned in the seam direction. When a series of detector cells aligned in the seam direction is utilized, the correction unit may be provided with an arrangement for the initiation of a supplemental correction, which arrangement responds in dependence on the movement of the end of the sewing material with respect to the recognition unit, if an initially performed correction has not taken place with the desired accuracy. The recognition unit may also comprise a detector cell matrix for the recognition of a previously stored pattern with a virtual desired seam end and for the activation of the correction unit in dependence on the spacing with respect to the desired seam end. Additionally, the recognition unit may be in the form of a scanner for scanning a mounting frame for the sewing material.

In a sewing machine installation utilizing a coordinate table, a recognition unit in the form of a series of detector cells or a detector cell matrix is provided when two seams are formed so as to be oriented at an angle to each other. Such a recognition unit enables the determination of a virtual angle-bisecting line of the angle formed by the two desired seam courses which, together with the correction unit, enables the placement of the puncture point at the desired end of the seam automatically at the point of intersection of the actual seam routes on the virtual angle-bisecting line. This arrangement of a recognition unit and correction unit also enables a supplemental correction to be effected if an initially performed correction has not taken place with the desired accuracy.

These and other objects, features and advantages of the invention will be come clear from the following description taken in connection with the accompanying drawings.

FIG. 11 illustrates, in a schematic view, a modified arrangement of the recognition unit;

FIG. 12 illustrates output signals of the recognition unit according to FIG. 11;

Figure 13:
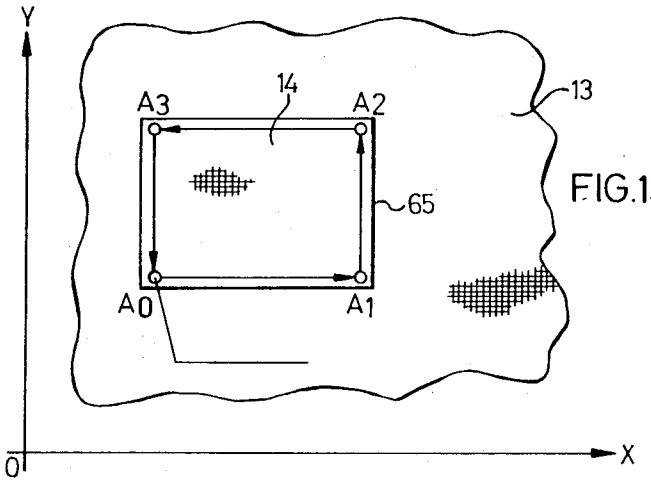
Figure 14:
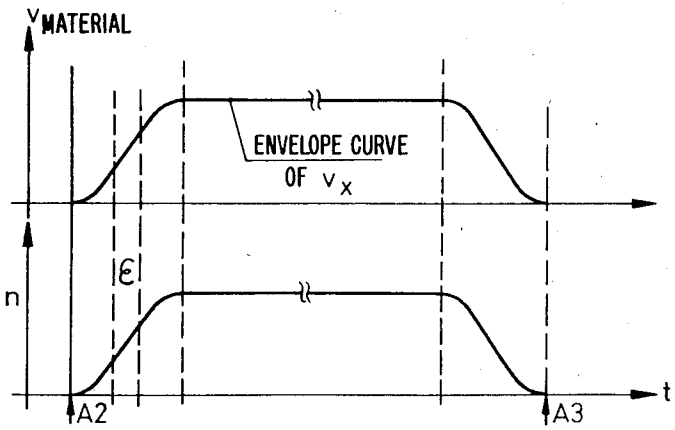
Figure 15:
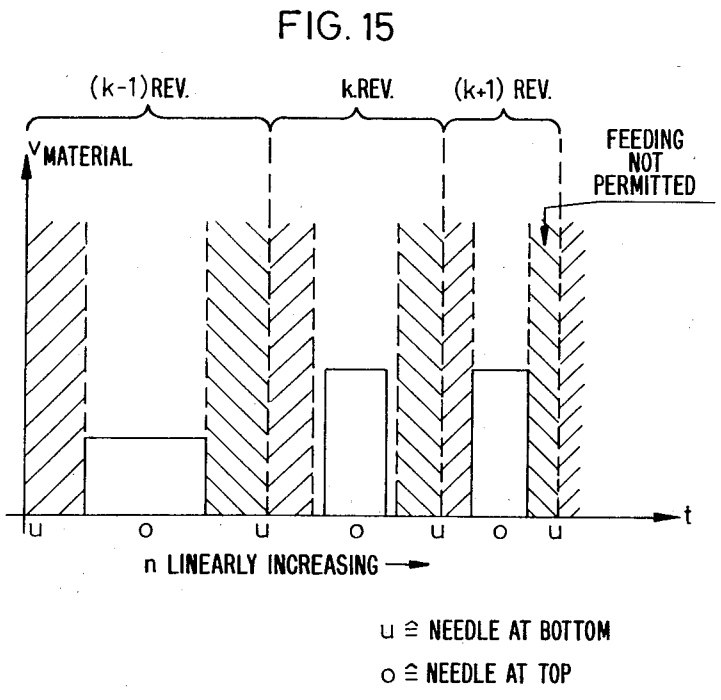
Figure 16:
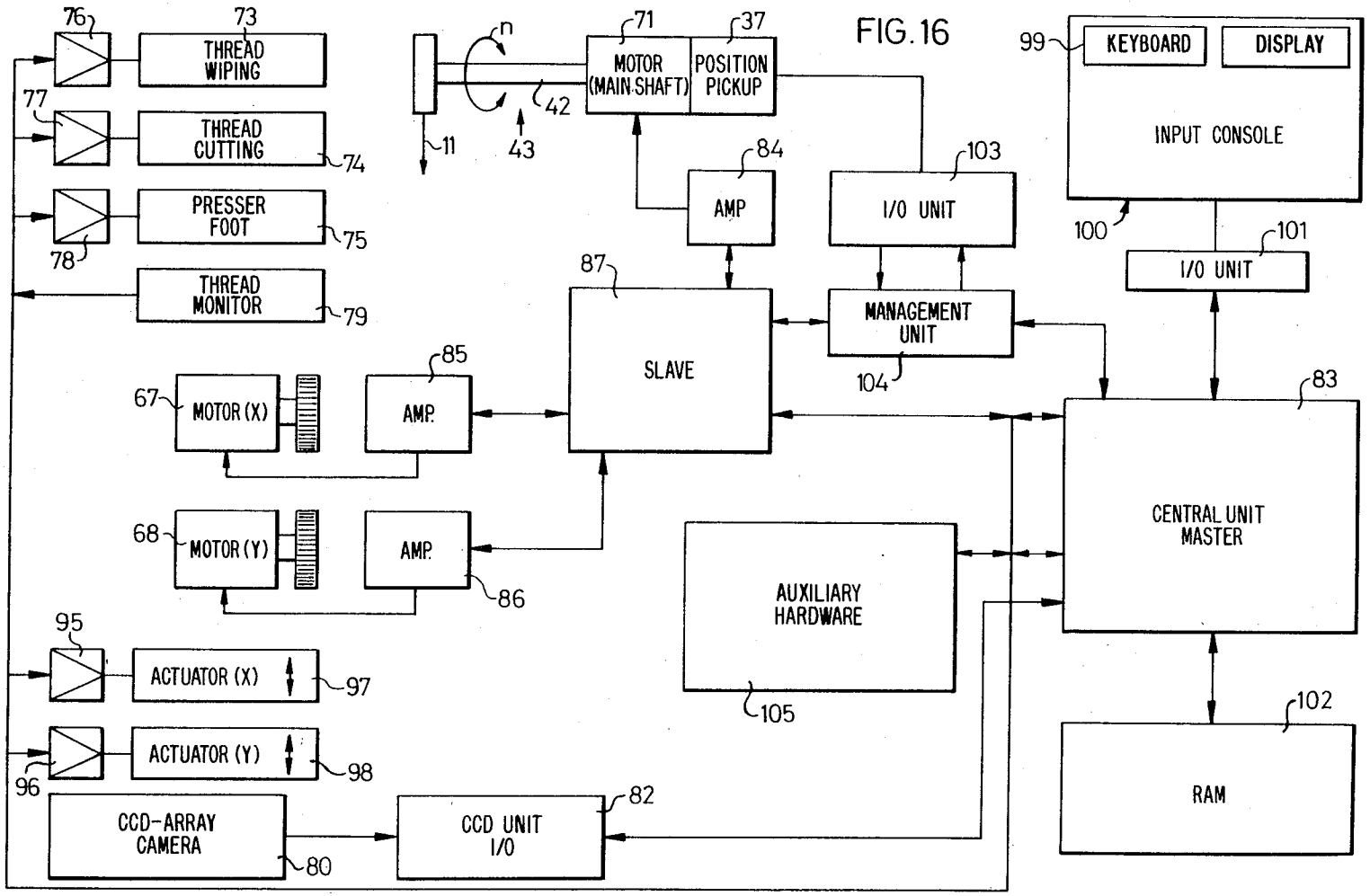
Figure 17:
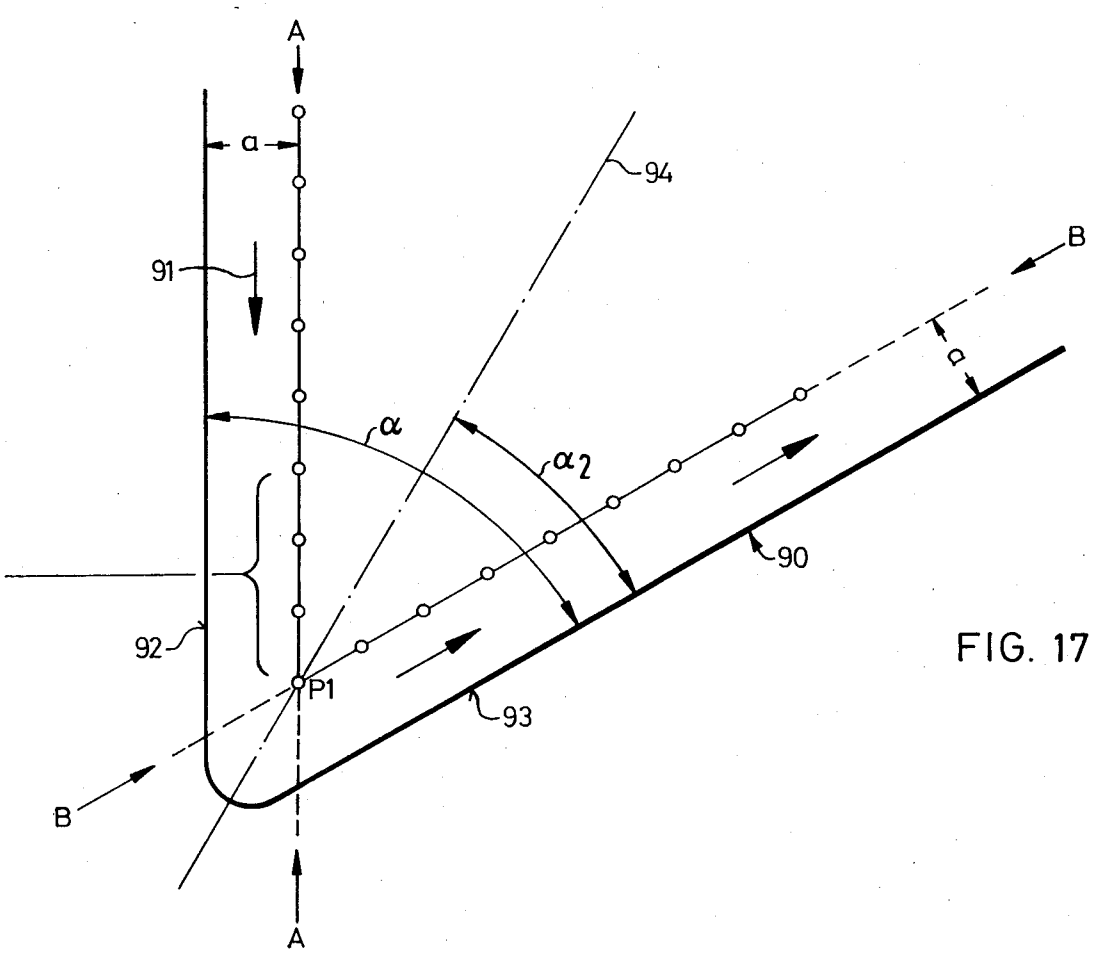

FIG. 13 schematically illustrates a frame for fastening sewing material, with the sewing material clamped therein;

FIG. 14 illustrates speed/time and number of revolutions/time diagrams for the sewing operation performed with the frame of FIG. 13;

FIG. 15 is a fragmentary view of the speed/time diagram of FIG. 14 on an expanded-time scale;

FIG. 16 is a detailed block circuit diagram of a drive and control device according to the present invention;

FIG. 17 is a top view of the corner of a collar;

FIG. 18 is a block circuit diagram of a synchronizing device provided in a sewing machine with needle feed; and FIG. 19 illustrates the signals occurring with the synchronizing device according to FIG. 18.

Figure 1:
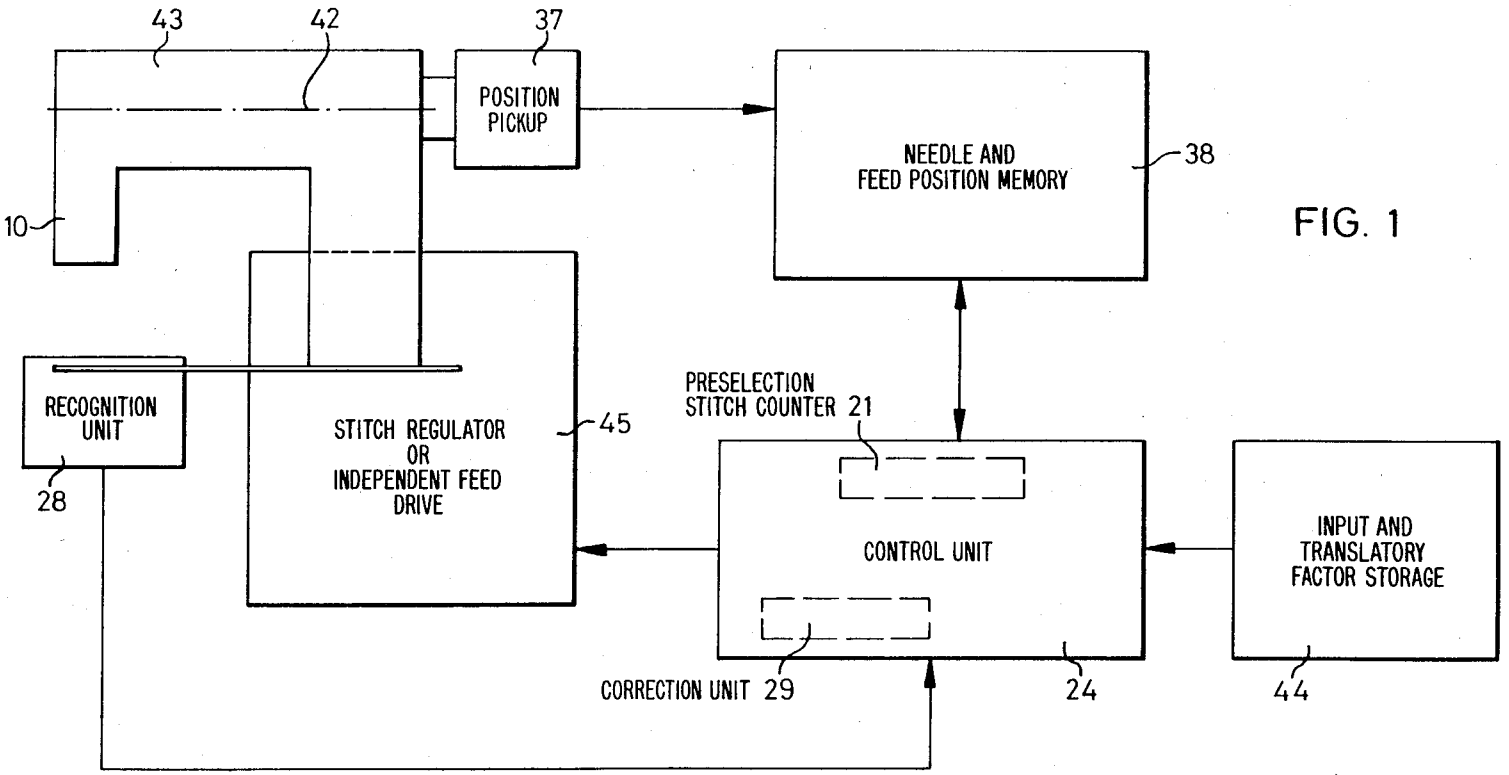
FIG. 1 is a block circuit diagram of a drive and control device according to the present invention.
Figure 2:
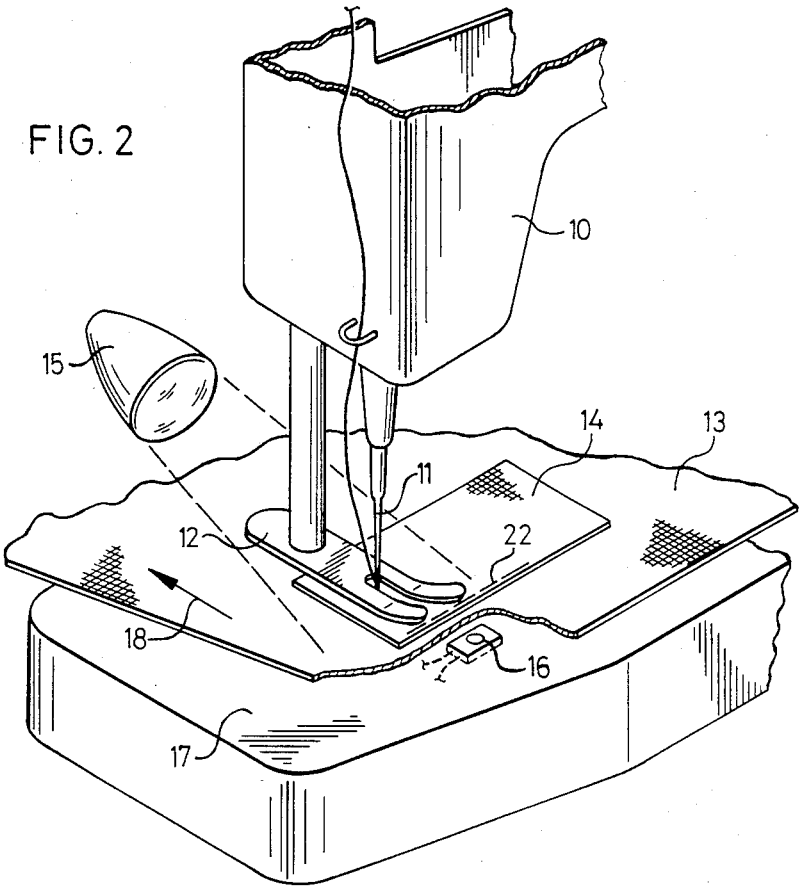
FIG. 2 is a partial view of a sewing machine with a recognition unit in the form of a transmission light barrier.
Figure 3:
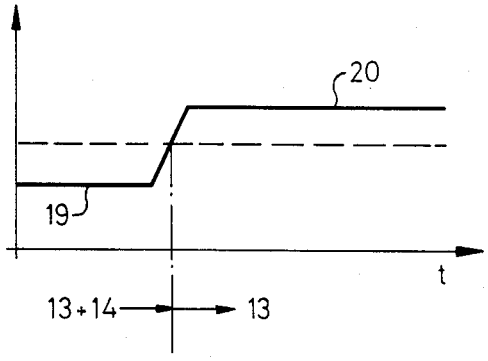
FIG. 3 illustrates the output signal of the recognition unit according to FIG. 2.

Referring now to the drawings wherein like reference numerals are utilized to designate like parts throughout the several views, FIG. 2 schematically illustrates an arm head 10 of a sewing machine with a needle 11 and a presser foot 12. In the illustrated embodiment, a label 14 is being sewn onto a base material 13, for example, a piece of clothing. A transmission light barrier is provided as a recognition unit, consisting of a light source 15 and a receiver 16. The receiver 16 is, for example, a planer photodiode mounted on a support 17 for the sewing material. The receiver 16 is at a spacing from the needle 11 as seen in the sewing direction. During operation, the sewing material 13, 14 is advanced in the feed direction indicated by the arrow 18 by means of a feed mechanism (not shown). During this step, the garment 13 and the label 14 initially cover the receiver 16. The output signal from receiver 16 has a low level 19 (FIG. 3). During further movement of the sewing material 13, 14, the label 14 finally uncovers the receiver 16. The output signal from receiver 16 jumps to a higher level 20. The jump from level 19 to level 20 activates a preselection stitch counting unit which presets a predetermined number of remaining stitches. This is the number of stitches to be performed in addition, following the level jump 19, 20 (the end recognition) in order to reach the desired end of the seam indicated at 22. The preselection stitch counting unit can be designed, as conventional (No. DOS 3,018,797), as a separate stitch counter. Preferably, the preselection stitch counting unit 21, however, is integrated with respect to hardware or software into a central control unit 24 and is shown in dashed line form in FIG. 1.

Figure 5:
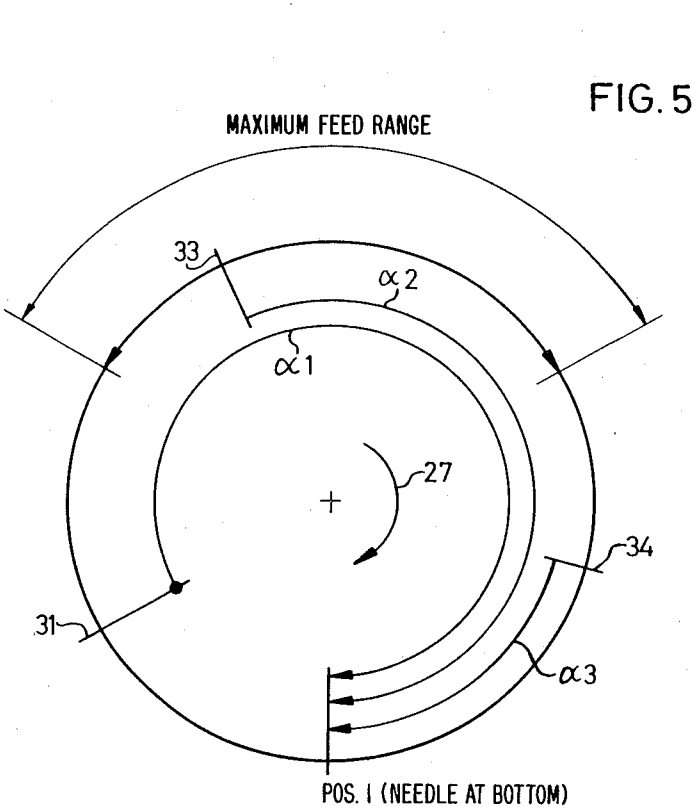
FIG. 5 is a circular diagram representing the revolving motion of the main shaft of the sewing machine.
Figure 4:
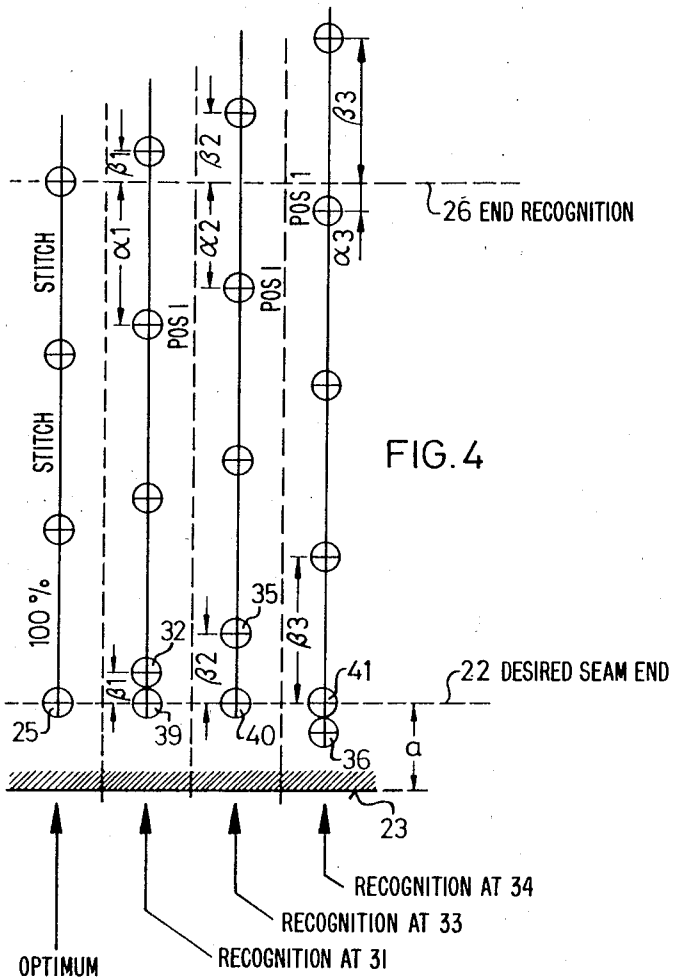
FIG. 4 is an enlarged schematic top view of a border zone of a sewing material with varying remaining stitch sequences.

As can be seen from the first remaining stitch sequence in the enlarged representation of FIG. 4, the last needle puncture 25 is, however, congruent with the desired puncture point, lying at a predetermined spacing a from the edge 23 of the sewing material, only if the spacing between the point of end recognition (indicated at 26 in FIG. 4) and the desired end 22 of the seam is an integral multiple of the remaining stitch length. However, the needle 11, can assume any arbitrary position at the instant of end recognition which will not result in the last needle puncture 15 occurring at the desired puncture point. Three additional examples for varying needle positions during end recognition are illustrated in FIGS. 4 and 5, wherein the latter can also be considered an enlarged top view of the end face of the sewing machine main shaft (42 in FIG. 1). In this connection, it is assumed that the main shaft revolves in the direction of arrow 27. A predetermined reference angle position of the main shaft, for example, the angle position corresponding to the bottom position of needle 11, is indicated with Pos. 1. The sewing material, in most types of sewing machines, may be advanced only when the needle 11 is pulled out of the sewing material. This leads to the maximum feed range indicated in FIG. 5. If now, for example, end recognition takes place in an angular position 31 removed from reference position Pos. 1 by the angle $\alpha_1$, then, without correction, the last needle puncture would lie at point 32 of FIG. 4. For other recognition instants, corresponding to the angular positions 33 and 34, removed from reference position Pos. 1 by the angles $\alpha_2$ and $\alpha_3$, respectively, with the use of the correction method according to No. DOS 3,018,797, the last needle punctures 35 and 36, respectively, according to FIG. 4, would be obtained. Therefore, the last needle puncture coincides only accidentally with the desired end 22 of the seam (at 25). However, in most cases, this last needle puncture will be more or less remote from the desired seam end 22 (up to one-half stitch length).

In order to overcome this drawback, a correction unit 29 controlled by a recognition unit 28 (as shown in FIG. 1) is provided in accordance with the present invention. This correction unit 29 automatically adjusts the length of at least one of the remaining stitches in dependence on the respective position of the needle 11 at the instant of end recognition. This correction unit 29 is preferably likewise integrated with respect to hardware or software into the central control unit 24 and is shown in dashed line form in the control unit in FIG. 1.

In the embodiment according to FIG. 4, correction takes place in the last stitch. In FIG. 5, an angle of 360° corresponds to one full stitch length. The stitch length of the last stitch is now shortened to a value corresponding, on the one hand, to the complementary angle $\beta=360°-\alpha$ and, on the other hand, to a machine-specific translatory factor between the needle position (angle $\alpha$ or $\beta$) and the feeding phase. Consequently, in accordance with the present invention, the last needle punctures 39, 40 and 41, respectively, are located at the desired seam end 22 also in the case of end recognition in angular positions 31, 33, 34. To effect this correction, the angle $\alpha$ or the associated complementary angle $\beta$ based on a fixed reference position of the main shaft, for example, the position Pos. 1 (needle at bottom) is measured by way of an incremental position pickup 37 (FIG. 1), and is stored in a memory 38 for correction of the last stitch together with the feed position present at end recognition. The position pickup 37 is directly coupled with the main shaft 42 of the sewing machine 43 as shown in FIG. 1. An input and storage unit 44 serves for the input and storage of the translatory factor. The correction unit 29 acts on a stitch regulator or an independent feed drive mechanism 45.

It is readily understood that the correction can also be extended at a remaining stitch other than the last remaining stitch, for example, at the penultimate stitch. This is recommended, in particular, if stitch length correction is effected by adjusting the stitch regulator of the sewing machine. Additionally, the variable stitch length correction can also be subdivided among several remaining stitches.

A modified arrangement of the present invention will be described with reference to FIG. 6 wherein a stitch length correction is provided toward plus and toward minus, i.e., in opposite directions, by a given fraction of the respective, full stitch length. In this arrangement, the desired seam end, the border of the sewing material, and the end recognition point are again denoted by 22, 23 and 26, respectively. It is assumed that the stitch length can be lengthened by 20% and shortened by 20%. The distance a here again is the desired, constant spacing between the desired seam end 22 and the edge 23 of the sewing material.

As in the case of the arrangement according to FIGS. 4 and 5, the angle $\alpha$ is measured and stored when the end recognition point 26 has been reached. The complementary angle $\beta$ can be determined by the subtraction $\beta=360°-\alpha$. In correspondence with the illustration in principle shown in FIG. 1, the angular position of the sewing machine 43, driven by a drive motor, not shown, is determined by the incremental position pickup 37, which latter transmits signals in dependence on fractions of a complete revolution of the main shaft 42. It is assumed that a full revolution of the main shaft 42, i.e., a rotary angle of 360°, corresponds to a number N of pulses of the position pickup 37. The position pickup pulse number corresponding to angle $\alpha$ will be denoted by $N_1$. The correction unit 29 than compares the angles $\alpha$ and $\beta$ with 360/2, and/or the pulse numbers $N_1$ and $N-N_1=N_2$ with N/2. Upon the determination that $\alpha<360/2$ and/or $N_1<N/2$, the value $N_1/0.2N$ is formed and then rounded off to an integer amount. This integer amount indicates the number of last stitches which must be shortened by 20%.

However, if it is found that $\alpha>360°/2$ and/or $N_1>N/2$ or $\beta<360°/2$ and/or $N_2<N/2$, then the value $N_2/0.2N$ is calculated and thereafter rounded off to an integer amount. This amount corresponds to the number of last stitches to be lengthened by 20%.

However, if $\alpha \hat{=} N_1 < N/2$ but $N_1/0.2N < 0.5$, or $\beta \hat{=} N_2 < N/2$ but $N_2/0.2N < 0.5$, then no correction will take place any more, since the error is smaller than 10% of the stitch length and could be corrected only by a still finer correction step.

Figure 6:
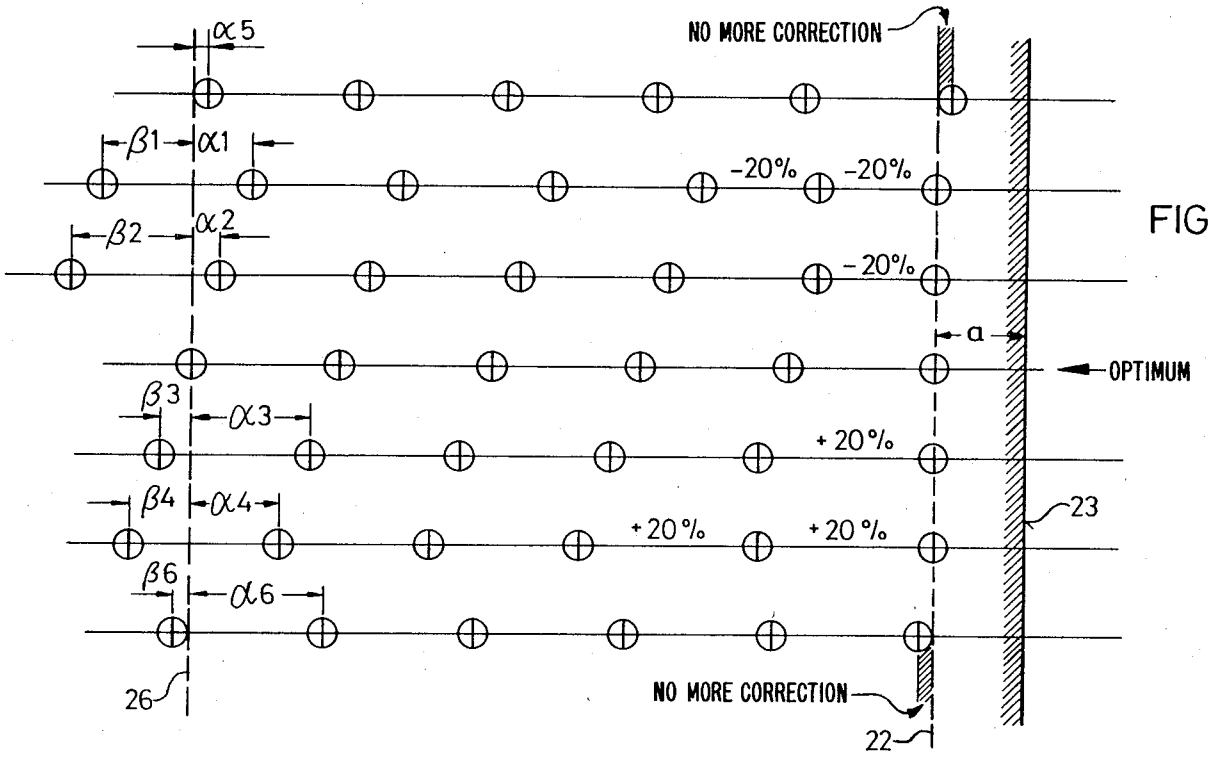
FIG. 6 is a top view similar to FIG. 4 with remaining stitch sequences as obtained with a modified correction unit.

The corresponding relationships are compiled in FIG. 6 wherein the uppermost and the lowermost sequences of stitches concern the last-cited case where no correction is effected (measured angles $\alpha_5$ or $\alpha_6$, $\beta_6$). As can be seen, the angles $\alpha_1$, $\beta_1$ require two steps of shortening the stitch length. In case of angles $\alpha_2$, $\beta_2$, one stitch length shortening operation is sufficient. In the stitch sequence indicated therebelow, the normal stitch length leads to the desired seam end 22. The angles $\alpha_3$, $\beta_3$ require a single stitch lengthening, whereas the angles $\alpha_4$, $\beta_4$ necessitate two steps of stitch lengthening.

For the assumed case of a correction by +20% or −20% of the normal stitch length, maximally two remaining stitches are varied in length, as can be seen from FIG. 6. While FIG. 6 shows a correction for the last stitch or for the two last stitches, it is understood that a corresponding correction within the remaining stitch sequence can also be performed earlier, for example, at the second-to-last and third-to-last stitches.

The stitch length correction according to FIG. 6 is not restricted to correction steps of 20%, either. Rather, in general, correction steps of X% are possible. In correspondence with the above-described procedure, here again a comparison is made of $\alpha \hat{=} N_1$ with N/2

$\beta \hat{=} N_2$ with N/2

$\alpha$ with $\beta$

If it is found, for example, that $\alpha \hat{=} N_1 < N/2$, then $N_1/X\%.N$, rounded off to an integer, yields the number of corrections to be effected with −X%.

If $N_1/X\%.N = 0.5$, no correction takes place;

if $0.5 < N_1/X\%.N < 1.5$, a single correction occurs with −X%;

if $1.5 < N_1/X\%.N < 2.5$, two corrections with −X% are performed; and so on.

In contrast, if $\alpha \hat{=} N_1 > N/2$ and/or $\beta \hat{=} N_2 < N/2$, then $N_2/X\%.X$, rounded off to an integer, yields the number of corrections to be effected with +X%.

If $N_2/X\%.N < 0.5$, no correction takes place;

if $0.5 < N_2/X\%.N < 1.5$, a single correction occurs with +X%;

if $1.5 < N_2/X\%.N < 2.5$, two corrections are performed with +X%;

if $2.5 < N_2/X\%.N < 3.5$, three stitch lengths are expanded by respectively +X%.

Thus, correction takes place in all cases only if the deviation is larger than 0.5X, i.e., larger than half the smallest shortening possible or smallest lengthening possible.

In this correction, the correlation is of importance between stitch length and correction length, i.e., +X or −X. It must be possible to effect the correction as a predetermined fraction of the respectively set stitch length.

For purposes of simplification, it has been assumed within the scope of the above explanation of FIGS. 4 and 6, that the translatory factor between the needle position and the feeding phase is constant and is equal to 1. This condition leads to the indicated correction algorithms. However, if unit 44 of FIG. 1 introduces a translatory factor $k_{\alpha T}$ different from 1, which factor can be constant or can be a function of the feeding phase at the instant of end recognition, then the value $\alpha$ must be replaced by $\alpha_{k_{\alpha T}}$ in the aforementioned correction algorithms. The translatory factor can be preset, for example, digitally as concerns the hardware. The factor can also be derived, as concerns the software, for example, from tables contained in an EPROM storage device. In case of a feeding phase dependency on the translatory factor, the unit 44 is suitably activated via the memory 38.

Figure 7:
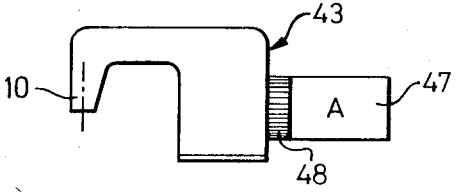
FIG. 7 is a schematic lateral view of a sewing machine with a stitch length adjustment actuator.

The correction unit 28 can be connected to an actuator 47 in the embodiment of FIGS. 4 and 5 as well as in the arrangement of FIG. 6. This actuator, in turn, acts on the stitch regulator, for example, in the form of a stitch length setting wheel 48 of the sewing machine 43, as indicated in FIG. 7. In the arrangement according to FIGS. 4 and 5, the actuator must permit continuous or multistage variation of the stitch length, whereas for the arrangement of FIG. 6, a stitch length adjustment by ±X% is adequate. The actuator 47 can be, for example, a stepping motor.

Figure 8:
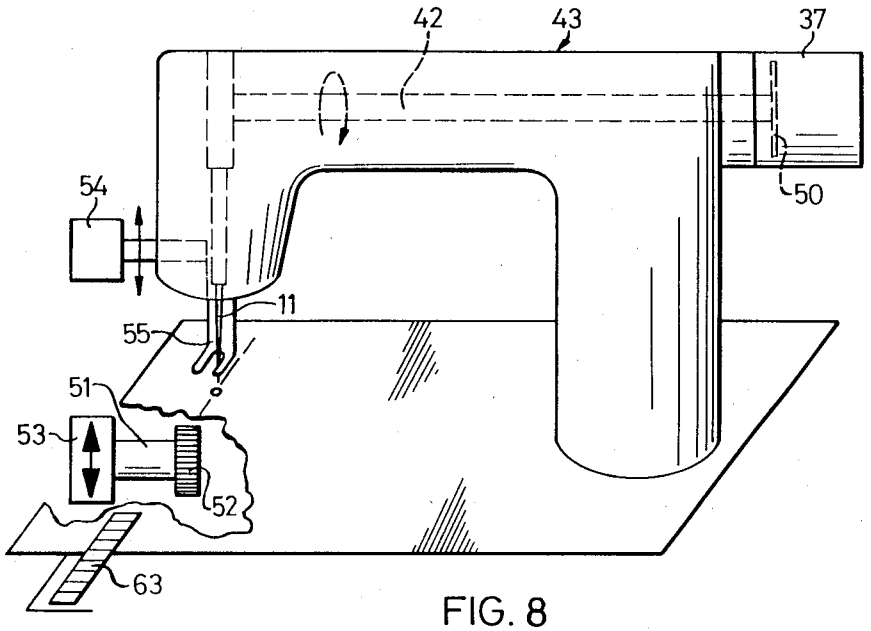
FIG. 8 is a schematic view of a sewing machine with a separate feed drive mechanism.

In accordance with a modified arrangement, the correction unit 29 can activate a feeding unit which, during execution of the remaining stitches, can be disengaged from the sewing material for a portion of the feeding movement for stitch length setting. One arrangement of this type is illustrated in FIG. 8. The main shaft 42 of the sewing machine 43 is again driven, in a manner not shown in detail, by way of a drive motor. The incremental position pickup 37, consisting, for example, of a slotted disk 50 cooperating with a light barrier, is seated on the main shaft 42 or on an extension of this shaft. Feeding of the sewing material 13, 14 is effected with the aid of a separate motor 51, with which a feed wheel 52 is connected. The feed wheel 52 can be adjusted, optionally together with the motor 51, in the upward direction, i.e., for advancing toward the sewing material, or in the downward direction (away from the sewing material, if no feeding is desired), by means of an electromagnet 53. The drive means for the main shaft 42 and the electromagnet 53 are synchronized with each other in a manner not shown in detail via an incremental electrical shaft replacing the mechanical transmission which, in mechanical sewing machines conventionally synchronizes the feeding movement and the needle movement. An actuator 54 moves the presser foot 55 toward the sewing material and then provides feeding by means of the drive unit 51, 52.

Figure 10:
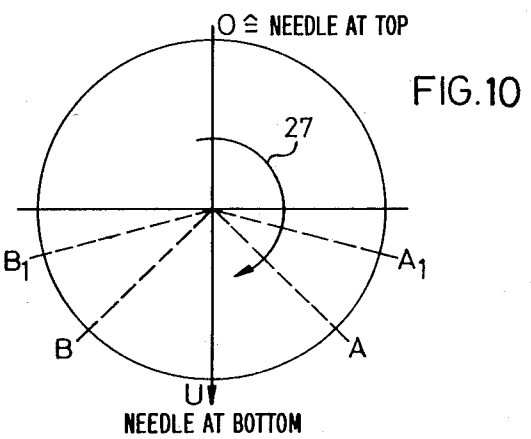
FIG. 10 is a circular diagram similar to FIG. 5.
Figure 9:
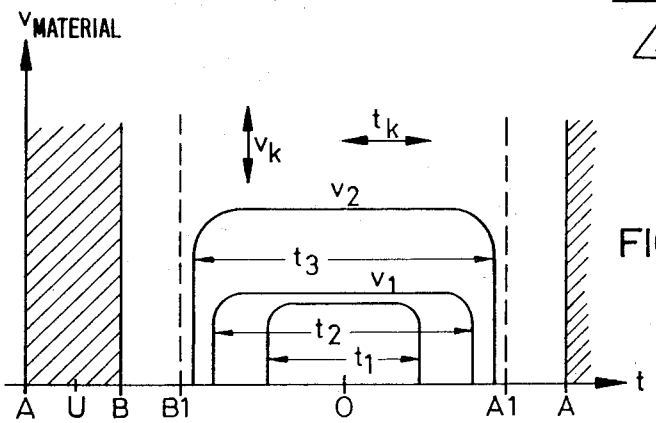
FIG. 9 is a speed/time diagram revealing various correction possibilities of the arrangement according to FIG. 8.

It is possible to eliminate the electromagnet 53 or an equivalent actuator if the feed motor 51 is designed so that it can be started within the time period provided for the formation of a remaining stitch, accelerated to the desired number of revolutions corresponding to the speed v of the material, and braked again to a standstill. In such an arrangement, the feed wheel 52 can remain in permanent contact with the sewing material. Feeding takes place in accordance with the curves of FIG. 9. In this connection, the sewing material is moved only in the permitted sector $B_1 \rightarrow 0 \rightarrow A_1$ of FIGS. 9 and 10. Within this permitted sector, the needle 11 is with certainty outside of the sewing material. The zone $A \rightarrow U \rightarrow B$, blocked against feeding, is shaded in FIG. 9. If the sewing material moves during feeding, without slipping, the path of the material traversed per revolution of the main shaft 42 (i.e., the stitch length) is given by $w_k \pm v_k \cdot t_k$ This means that the stitch length $w_k$ can be affected by varying the speed of the material $v_k$, as well as by the duration of the feed $t_k$. Different possibilities for variation are indicated in FIG. 9 with the speeds $v_1$ and $v_2$, as well as with the different feeding periods $t_1$, $t_2$ and $t_3$. The zones B→U (needle at bottom)→A and $B_1$→0 (needle at top)→$A_1$, as well as the feeding times $t_k$ are detected or set, at a set speed $v_k$ of the material, by counting the pulses from the position pickup 37, because the time for the revolution of the main shaft 42 from $B_1$ via 0 to $A_1$ is a function of the number of revolutions of the main shaft.

In sewing machines with needle feed, care must be taken additionally that the feeding motion and the horizontal component of the needle movement occur synchronously. For this purpose, a synchronizing device is provided which guides the feeder in close dependency on the, for example, sinusoidal horizontal needle movement in such a way that feeding of material takes place even when the needle is in the downward position. One embodiment of such a synchronizing device is illustrated in FIG. 18. The position pickup 37 activates a generator 56, which latter yields a sine wave-like output signal $U_g$ according to FIG. 19. This signal is fed to a voltage-controlled oscillator 57, the output signal $f_{VCO}$ of which activates the feed motor 51, designed as a stepping motor in this case. The half waves of the signal $U_g$ are in synchronism with the horizontal component of the movement of the needle entering the sewing material, whereas the amplitude of the signal $U_g$ is proportional to the number of revolutions of the main shaft. Since $f_{VCO}$ is proportional to $U_g$ and the stepping speed of the feed motor 51, in turn, is proportional to $f_{VCO}$, the sewing material is advanced in the desired way. A directional signal for stitch reversal can be applied to the feed motor 51 via a conductor 58.

In place of a transmission light barrier, as illustrated in FIG. 2, it is also possible to provide, for end recognition, a conventional reflection light barrier as disclosed in No. DOS 3,018,797. The recognition unit 28 may also be in the form of a UV light transmitter/receiver unit. In such a case, pieces of material to be sewed on, such as pockets, labels, or the can be impregnated entirely or only in a marginal region with an ink sensitive to UV light becoming visible only under UV light. The UV light transmitter/receiver unit then detects the border between the ink responsive to UV light and areas not impregnated with such an ink.

FIG. 11 shows schematically a further modified arrangement of the recognition unit 28. This involves a shadow detector with two alternatingly activatable light sources 59 (LS I), 60 (LS II) and a light receiver 61. The light source 59, located in the sewing direction in front of the rim or edge 23 of the label 14, produces a shadow indicated at 62 once the rim is hit by the collimated light beam of this light source. The collimated light beam of the light source 60, which latter is located in the sewing direction behind the rim of the label 14, does not throw any such shadow. By alternatively turning on the two light sources 59, 60 the rim 23 becomes recognizable as a jump in the output signal A from light receiver 61, as illustrated in FIG. 12 by the difference signals LS I and LS II. On the other hand, the output signals of the light receiver have the same value when only the label 14 or the base material 13 is present, although the value is different for the different materials.

The recognition unit 28 can also include a series of detector cells, e.g., photodiodes, aligned in the seam direction, which cells are responsive to the contrast between the label 14 and the base material 13. This series of cells can be preferably formed as a charge coupled device integrated circuit (CCD-IC). Such an integrated circuit block is indicated at 63 in FIG. 8. A recognition unit with detector cells has the advantage that the rim can be monitored over several cells. Thus, it is possible to detect not only the position of the rim, but also its velocity with respect to the series of detector cells. The performed correction can be controlled and, if necessary, a second correction can be effected subsequently if the first correction did not yield the desired result as yet.

Furthermore, the recognition unit 28 can be equipped with a detector cell matrix. Such a matrix can be made up of one or several CCD-array ICs. In this connection, the image of the sewing material, for example, a label 14, which can be positioned under a CCD camera, can be detected on the base material 13 and compared in a computer system with an initially stored pattern image.

Another arrangement includes providing a recognition unit with a scanner which scans a mounting frame for the sewing material. In such a scase, the label 14, a pocket, or the like is placed over the base material 13 and then fastened with the aid of a frame consisting, for example, of metal and schematically indicated at 65 in FIG. 13. The unit consisting of the base material 13, label 14, and mounting frame 65 can then be processed in an automatic sewing installation such as on a coordinate table. The sewing material is moved in both directions X and Y. A central control unit or computer of the automatic sewing installation controls the drive mechanism for the main shaft and, thus, the needle motion, as well as an X-drive and a Y-drive in such a way that, for example, according to FIG. 13, the counter $A_0$—$A_1$—$A_2$—$A_3$ is sewed. The number of revolutions n of the main shaft determines the material velocity $v_{Material}$. A movement of the sewing material takes place as explained above with references to FIGS. 9 and 10, wherein feeding again is permitted merely within the zone $B_10A_1$. In a deviation from the previously described embodiment, however, movements of the material are executed in the X and Y directions.

FIG. 14 illustrates speed time and number of revolutions/time diagrams for the sewing operation performed with the frame of FIG. 13. As shown therein, the average speed of the material $v_{Material}$ is varied, for example, when producing the seam from $A_2$ to $A_3$ in dependence on the number of revolutions n of the machine, because the sewing machine must be accelerated from standstill to the operating speed and, at the end of the seam, must be braked again to standstill. In this connection, the seam is to be executed as one with constant stitch length. In order to make sure of this, the path of the material $w_x = v_x \cdot t_x$, traversed for each stitch, must be kept constant. So that this condition is maintained even in the acceleration and braking ranges, the central unit regulates the feeding period and the speed of the material in the manner as more clearly illustrated in FIG. 15 which shows the time range $\epsilon$ of FIG. 14 on an expanded scale. As is apparent from FIG. 15, the feeding period available for each stitch decreases during acceleration. In order to keep the stitch length at a uniform value, the feeding speed must thus be correspondingly increased with the feeding phases available for the individual stitches. In the above-described manner, the correction unit takes care also in this case of the correction that may be required in the region of the end of the seam, in that the correction unit shortens or lengthens the stitch length of one or several remaining stitches. The end recognition can in this case take place, for example, by way of a scanner of the recognition unit, scanning the mounting frame 65.

FIG. 16 shows a block circuit diagram for a sewing installation with coordinate drive. For the X-Y motion, a twin-motor control drive unit is provided, with a motor 67 for the feeding in the X-direction and a motor 68 for transporting in the Y-direction. The main shaft 42 of the sewing machine 43 is driven by a motor 71. The position pickup 37 is connected with the main shaft 42. At 73, 74 and 75, respectively, the drawing shows pneumatic, electromechanic, or other types of actuators for auxiliary functions, such as thread wiping, thread cutting, presser foor operation, and the like. The actuators 73–75 are activated by way of associated power stages 76, 77 and 78, respectively. A thread monitoring member 79 monitors the proper thread feed. A camera 80 oriented onto the sewing material and equipped preferably with a CCD array yields information regarding the pattern recognition and the movement of the sewing material in relation to the sewing foot, i.e., the needle 11. This information is processed in an image processing unit, for example, CCD unit 82 and passed on from there to a central unit 83 which latter is suitably a microprocessor master unit. The central unit 83 coordinates the movements of the main shaft 42 as well as the feeding in axes X and Y by way of corresponding power amplifiers 84, 85 and 86, respectively. Coordination is carried out with the interposition of a slave microcomputer 87. The auxiliary functions, such as thread wiping, thread cutting, presser foot operation, etc., are controlled directly via the outputs of the central unit 83. During the sewing operation, the camera 80 monitors the sewing material and provides the data for the afore-described correction process and for the positioning.

If, for example, a collar as shown schematically at 90 in FIG. 17 is to be sewn along the edge, then this collar is first recognized by the camera 80 as a pattern on the tabletop of the sewing machine. Thereafter, the sewing operation is initiated to the effect that the collar is sewn in the sewing direction (arrow 91) up to the corner 92. The camera 80 monitors the seam and transmits information to the central unit 83. The virtual angle-bisecting line 94 passing through the point of intersection P1 of the seam directions is formed for the desired seam directions A—A, B—B drawn virtually with the aid of pattern recognition and extending at a spacing a from the rim 93 of the collar. Via power states 95, 96, the central unit 83 activates actuators (97 for the X-direction) and 98 (for the Y-direction), respectively; these actuators can correspond, for example, to the actuator 53 in FIG. 8. Thereby, if necessary, the stitch length of one or several remaining stitches is corrected so that the first seam terminates exactly in point P1 or, in any event, in a point lying on the angle-bisecting line 94. Starting with this point, sewing then begins in direction B—B.

All commands are introduced via an alphanumeric keyboard 99 of an input console 100, such as:

drive into position 1,
revolve main shaft slowly in one or the other direction,
feed slowly in X- or Y-direction,
store attained position of main shaft,
lift or lower presser foot,
conduct testing program, etc.

The input console 100 is connected to the central unit 83 by way of an input/output unit 101. Furthermore, a buffered RAM storage device 102 is connected to the central unit 83 for storing the data concerning angular positions, pattern recognition, translatory factor, type of synchronization between needle movement and feeding movement and the like. The data transmission between the position pickup 37, the central unit 83, and the slave microprocessor 87 takes place via a position pickup input/output unit 103 and a pulse management unit 104. Auxiliary hardware, such as counters, flip-flops, etc., is indicated by block 105 in FIG. 16.

While we have shown and described several embodiments in accordance with the present invention, it is understood that the same is not limited thereto but is susceptible of numerous changes and modifications as known to those skilled in the art and we, therefore, do not wish to be limited to the details shown and described herein but intend to cover all such changes and modifications as are encompassed by the scope of the appended claims.

What is claimed is:

1. A drive and control device for an automatic sewing machine arrangement wherein stitches of a seam are sewn in a sewing material, the drive and control device comprising recognition means for determining as an end recognition when a sewing member of the automatic sewing machine arrangement has approached a predetermined spacing from a desired seam end of the sewing material and for providing an output indicative thereof, preselection stitch counting means responsive to the output of the recognition means for presetting a predetermined number of remaining stitches of the seam to be executed subsequently to the end recognition, and correction means for enabling stitch correction in dependence on the respective position of a sewing needle means of the automatic sewing machine arrangement at the time of end recognition by the recognition means, the correction means automatically increasing the length of at least one of the remaining stitches of the seam for enabling the sewing needle means to puncture the sewing material at least proximate to the desired seam end.

2. A drive and control device for an automatic sewing machine arrangement wherein stitches of a seam are sewn in a sewing material, the drive and control device comprising recognition means for determining as an end recognition when a sewing member of the automatic sewing machine arrangement has approached a predetermined spacing from a desired seam end of the sewing material and for providing an output indicative thereof, preselection stitch counting means responsive to the output of the recognition means for presetting a predetermined number of remaining stitches of the seam to be executed subsequently to the end recognition, correction means for enabling stitch correction in dependence on the respective position of a sewing needle means of the automatic sewing machine arrangement at the time of end recognition by the recognition means, the correction means automatically adjusting the length of at least one of the remaining stitches of the seam for enabling the sewing needle means to puncture the sewing material at least proximate to the desired seam end, and means for storing a machine-specific translatory factor for the automatic sewing arrangement of the relation between the position of the sewing needle means and the feeding phase of the automatic sewing machine arrangement and for providing an output indicative thereof.

3. A drive and control device according to claim 2, wherein the correction means is responsive to the output of the translatory factor means at least with respect to the feeding phase prevailing at the time of end recognition.

4. A drive and control device according to claim 2, further comprising means for storing the position of the sewing needle means at the time of end recognition as an incremental value with respect to a reference position of the sewing needle means and for providing an output indicative thereof.

5. A drive and control device according to claim 4, wherein the needle position storing means further stores the feeding phase prevailing at the time of end recognition and provides an output indicative thereof.

6. A drive and control device according to claim 4, wherein the correction means is responsive to the needle position storing means for varying the length of at least one remaining stitch by an amount directly dependent on the needle position prevailing at the time of end recognition.

7. A drive and control device according to claim 6, wherein the correction means varies the length of the at least one remaining stitch in a continuous or stepwise manner.

8. A drive and control device according to claim 4, wherein the correction means is responsive to the needle position storing means for varying the length of a number of remaining stitches by a predetermined fraction of a respectively provided full stitch length in dependence upon the needle position prevailing at the time of end recognition.

9. A drive and control device for an automatic sewing machine arrangement wherein stitches of a seam are sewn in a sewing material, the drive and control device comprising recognition means for determining as an end recognition when a sewing member of the automatic sewing machine arrangement has approached a predetermined spacing from a desired seam end of the sewing material and for providing an output indicative thereof, preselection stitch counting means responsive to the output of the recognition means for presetting a predetermined number of remaining stitches of the seam to be executed subsequently to the end recognition, correction means for enabling stitch correction in dependence on the respective position of a sewing needle means of the automatic sewing machine arrangement at the time of end recognition by the recognition means, the correction means automatically adjusting the length of at least one of the remaining stitches of the seam for enabling the sewing needle means to puncture the sewing material at least proximate to the desired seam end, and means for storing the position of the sewing needle means at the time of end recognition as an incremental value with respect to a reference position of the sewing needle means and for providing an output indicative thereof, the correction means being responsive to the needle position storing means for varying the length of a number of remaining stitches by a predetermined fraction of a respectively provided full stitch length in dependence upon the needle position prevailing at the time of end recognition, the correction means enabling at least lengthening the stitch length in dependence on the needle position.

10. A drive and control device according to claim 9, wherein the correction means varies the length of at least one of the remaining stitches in accordance with a relation between the needle position and the feeding phase at the time of end recognition and between the set full stitch length and the predetermined fraction of the full stitch length.

11. A drive and control device according to claim 2, wherein the automatic sewing machine arrangement includes a stitch regulator, the correction means being coupled with the stitch regulator for enabling stitch correction.

12. A drive and control device according to claim 2, wherein the automatic sewing machine arrangement includes a feeding means for engaging and feeding the sewing material, the correction means being coupled with the feeding means for enabling disengagement of the sewing material by the feeding means for varying the stitch length during the execution of the remaining stitches.

13. A drive and control device for an automatic sewing machine arrangement wherein stitches of a seam are sewn in a sewing material, the drive and control device comprising recognition means for determining as an end recognition when a sewing member of the automatic sewing machine arrangement has approached a predetermined spacing from a desired seam end of the sewing material and for providing an output indicative thereof, preselection stitch counting means responsive to the output of the recognition means for presetting a predetermined number of remaining stitches of the seam to be executed subsequently to the end recognition, correction means for enabling stitch correction in dependence on the respective position of a sewing needle means of the automatic sewing machine arrangement at the time of end recognition by the recognition means, the correction means automatically adjusting the length of at least one of the remaining stitches of the seam for enabling the sewing needle means to puncture the sewing material at least proximate to the desired seam end, the automatic sewing machine arrangement including a feeding means for engaging and feeding the sewing material, the correction means being coupled with the feeding means for enabling disengagement of the sewing material by the feeding means for varying the stitch length during the execution of the remaining stitches, and additional feeding means, the correction means being coupled to the additional feeding means for feeding the sewing material during the execution of the remaining stitches.

14. A drive and control device according to claim 13, wherein the correction means varies the length of at least one of the remaining stitches by controlling at least one of the feeding velocity and the time length of feeding of the sewing material.

15. A drive and control device according to claim 2, wherein the automatic sewing machine arrangement includes two drives for effecting movement in two orthogonal directions, the correction means controlling the operation of at least one of the two drives.

16. A drive and control device for an automatic sewing machine arrangement wherein stitches of a seam are sewn in a sewing material, the drive and control device comprising recognition means for determining as an end recognition when a sewing member of the automatic sewing machine arrangement has approached a predetermined spacing from a desired seam end of the sewing material and for providing an output indicative thereof, preselection stitch counting means responsive to the output of the recognition means for presetting a predetermined number of remaining stitches of the seam to be executed subsequently to the end recognition, correction means for enabling stitch correction in dependence on the respective position of a sewing needle means of the automatic sewing machine arrangement at the time of end recognition by the recognition means, the correction means automatically adjusting the length of at least one of the remaining stitches of the seam for enabling the sewing needle means to puncture the sewing material at least proximate to the desired seam end, the sewing needle means effecting feeding of the sewing material, and synchronizing means for detecting the horizontal component of movement of the sewing needle means and for regulating a feed drive means in accordance therewith.

17. A drive and control device according to claim 2, wherein the recognition means includes light responsive means for providing an output signal as the end recognition.

18. A drive and control device according to claim 17, wherein the light responsive means includes one of a light transmission member and a light reflection member.

19. A drive and control device according to claim 17, wherein the recognition means comprises a UV light transmitter-receiver means for recognition of a border of the sewing material having an ink provided thereon which lights under UV light.

20. A drive and control device according to claim 17, wherein the recognition means comprises shadow detector means for recognizing an edge of the sewing material, the shadow detector means including at least two alternatingly activatable light source means exposing the sewing material to light therefrom and light receiver means for determining the light level difference therebetween.

21. A drive and control device according to claim 17, wherein the recognition means includes a series of detector cells aligned in the seam direction.

22. A drive and control device for an automatic sewing machine arrangement wherein stitches of a seam are sewn in a sewing material, the drive and control device comprising recognition means for determining as an end recognition when a sewing member of the automatic sewing machine arrangement has approached a predetermined spacing from a desired seam end of the sewing material and for providing an output indicative thereof, preselection stitch counting means responsive to the output of the recognition means for presetting a predetermined number of remaining stitches of the seam to be executed subsequently to the end recognition, correction means for enabling stitch correction in dependence on the respective position of a sewing needle means of the automatic sewing machine arrangement at the time of end recognition by the recognition means, the correction means automatically adjusting the length of at least one of the remaining stitches of the seam for enabling the sewing needle means to puncture the sewing material at least proximate to the desired seam end, the recognition means including light responsive means for providing an output signal as the end recognition, the recognition means including a series of detector cells aligned in the seam direction, the correction means including means for initiating a supplemental correction, the supplemental correction means being responsive to the movement of an end of the sewing material with respect to the recognition means, if an initially performed correction has not been effected with the desired accuracy.

23. A drive and control device according to claim 21, wherein the recognition means includes a detector cell matrix for recognizing a previously stored pattern with a desired seam end, the correction means being responsive to the recognition means determining the spacing with respect to the desired seam end.

24. A drive and control device according to claim 17, wherein the recognition means includes a detector cell matrix for recognizing a previously stored pattern with desired seam end, the correction means being responsive to the recognition means determining the spacing with respect to the desired seam end.

25. A drive and control device according to claim 2, wherein the correction means adjusts the length of at least one of the remaining stitches so that the sewing needle means punctures the sewing material at the desired seam end.

26. A drive and control device according to claim 1, wherein the correction means automatically increases the length of a plurality of the remaining stitches of the seam.

27. A drive and control device according to claim 1, wherein the correction means automatically increases the length of only one of the remaining stitches of the seam.

28. A drive and control device for an automatic sewing machine arrangement wherein stitches of a seam are sewn in a sewing material, the drive and control device comprising recognition means for determining as an end recognition when a sewing member of the automatic sewing machine arrangement has approached a predetermined spacing from a desired seam end of the sewing material and for providing an output indicative thereof, preselection switch counting means responsive to the output of the recognition means for presetting a predetermined number of remaining stitches of the seam to be executed subsequently to the end recognition, and correction means for enabling stitch correction in dependence on the respective position of a sewing needle means of the automatic sewing machine arrangement at the time of end recognition by the recognition means, the correction means automatically adjusting the length of only one of the remaining stitches of the seam for enabling the sewing needle means to puncture the sewing material at least proximate to the desired seam end, wherein the only one of the remaining stitches of the seam being adjusted is a stitch other than the last stitch of the remaining stitches of the seam.

29. A drive and control device according to claim 28, wherein the correction means automatically adjusts the length of only a penultimate stitch.

30. A drive and control device for an automatic sewing machine arrangement wherein stitches of a seam are sewn in a sewing material, the drive and control device comprising recognition means for determining as an end recognition when a sewing member of the automatic sewing machine arrangement has approached a predetermined spacing from a desired seam end of the sewing material and for providing an output indicative thereof, preselection switch counting means responsive to the output of the recognition means for presetting a pedetermined number of remaining stitches of the seam to be executed subsequently to the end recognition, and correction means for enabling stitch correction in dependence on the respective position of a sewing needle means of the automatic sewing machine arrangement at the time of end recognition by the recognition means, the correction means automatically adjusting the length of only one of the remaining stitches of the seam for enabling the sewing needle means to puncture the sewing material at least proximate to the desired seam end, wherein the only one of the remaining stitches of the seam being adjusted is a stitch other than the last stitch of the remaining stitches of the seam, the correction means automatically increasing the length of the only one of the remaining stitches.

31. A drive and control device according to claim 28, wherein the correction automatically reduces the length of the only one of the remaining stitches.

* * * * *